US006980877B1

(12) United States Patent
Hagino et al.

(10) Patent No.: US 6,980,877 B1
(45) Date of Patent: Dec. 27, 2005

(54) EMBROIDERING SYSTEM

(75) Inventors: Seiichiro Hagino, Chiryu (JP); Katsuhiko Kiwada, Nagoya (JP); Akira Sumiya, Ushiku (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/831,154

(22) Filed: Apr. 26, 2004

(51) Int. Cl.[7] ..... D05C 5/02
(52) U.S. Cl. ..... 700/138; 112/80.43
(58) Field of Search ..... 112/78, 80.43, 112/102.5, 470.01, 470.18, 470.19; 700/136, 700/138

(56) References Cited

U.S. PATENT DOCUMENTS 5,904,109 A * 5/1999 Asano ..... 112/102.5
6,012,402 A * 1/2000 Sekine ..... 112/102.5

FOREIGN PATENT DOCUMENTS

| | | |
|---|---|---|
| JP | 55-8626 | 3/1980 |
| JP | 2802395 | 9/1998 |

* cited by examiner

*Primary Examiner*—John J. Calvert
*Assistant Examiner*—Brian Kauffman
(74) *Attorney, Agent, or Firm*—Oblon, Spivak, McClelland, Maier & Neustadt, P.C.

(57) ABSTRACT

An embroidering system includes at least one embroidering machine having plural needles supplied with threads having different colors, and a control device for transmitting an embroidery data to the at least one embroidering machine so as to selectively drive the plural needles. The embroidery data is generated and memorized in the control device prior to being transmitted to the at least one embroidering machine. The embroidery data is corrected as required. It is preferable that the embroidery data is corrected as the basis for needle numbers for the respective needles and the colors of the threads supplied to the respective needles.

11 Claims, 3 Drawing Sheets

EMBROIDERING SYSTEM

This application is based on and claims priority under 0.35 U.S.C. 119 with respect to Japanese Patent Application 2002-299336, filed on Oct. 11, 2002, the entire content of which is incorporated herein by reference.

FIELD OF THE INVENTION

This invention generally relates to an embroidering machine with plural needles selectively driven in response to command from an operating unit.

BACKGROUND

Conventionally, an embroidering chine, which is provided with plural needles for embroidering a work piece, has been widely known. The plural needles are alternately operated in response to commands from an operating unit. The embroidery machine can thus stitch an embroidering pattern with plural colors on the work piece. For example, in this type of embroidering machine disclosed in Japanese Patent No. 2802395, an embroidery data specifies which thread should be supplied to each needle. More particularly, a thread with a color specified by the embroidery data is supplied to each corresponding needle. Therefore, the thread already being supplied to or to be supplied to the needle is designed to correspond to the thread specified by the embroidery data. That is, when the thread color of each needle is detected not to be identical to the thread color specified by the embroidery data, a display shows a command to change the currently supplied thread to a thread with the specified color.

However, the above-described embroidering machine is stopped from operation every time when the currently supplied thread is changed to another thread with the specified color. Especially when the embroidering machine is used for a commercial purpose, recent requirements have lead to improvement of embroidering performance with less work interruption.

A need exists to provide an improved embroidery machine capable of embroidering with less work interruption.

SUMMARY OF THE INVENTION

According to an aspect of the present invention, an embroidering system includes at least one embroidering machine having plural needles supplied with threads having different colors, and a control device for transmitting an embroidery data to the at least one embroidering machine so as to selectively drive the plural needles. The embroidery data is generated and memorized in the control device prior to being transmitted to the at least one embroidering machine. The embroidery data is corrected as required. It is preferable that the embroidery data is corrected as the basis for needle numbers for the respective needles and the colors of the threads supplied to the respective needles.

It is further preferable that one of the thread colors of the respective needles, that is most similar to a color specified by the embroidery data, is selected when the thread colors of the respective needles do not correspond to the color specified by the embroidery data upon correcting the embroidery data by the control device.

The control device can be physically separated from the at least one embroidering machine.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
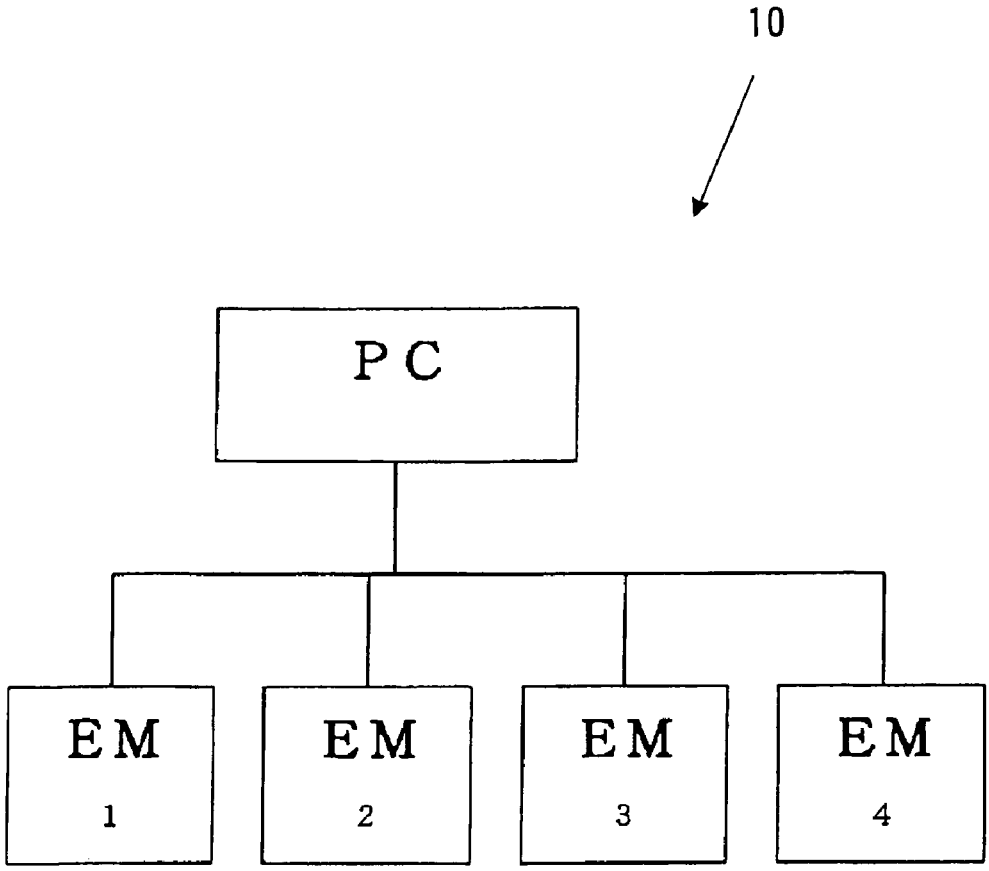
FIG. 1 is a block view illustrating an embroidery system of an embroidering machine according to an embodiment of the present invention.

As illustrated in FIG. 1, an embroidery system 10 according to an embodiment of the present invention includes a personal computer PC, i.e., a control device, connected to at least one embroidering machine EM. The personal computer PC according to the embodiment of the present invention is connected to four embroidering machines EM. The four embroidering machines EM are operatively driven based upon an embroidery data from the personal computer PC all together at a time or with a predetermined time gap therebetween.

Figure 2:
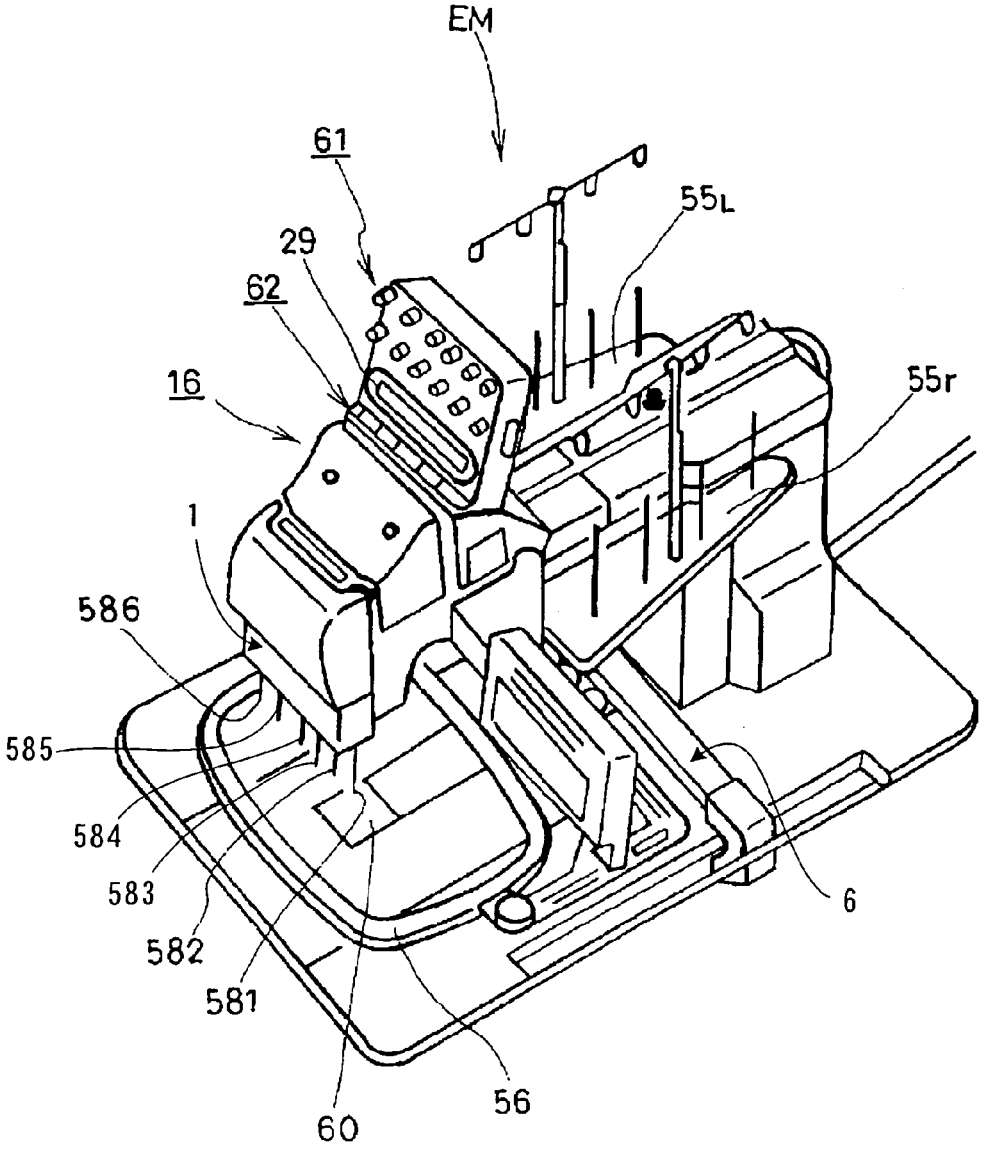
FIG. 2 is a perspective view illustrating the embroidering machine according to the embodiment of the present invention.

Explaining one of the embroidering machines EM with reference to FIG. 2, the embroidering machine EM is provided with an embroidery frame driving mechanism 6 for driving a known embroidery frame 56 at a horizontal plane in one of directions of axis and Y-axis, a known embroidering mechanism 1 for reciprocating a needle over a center hole 60, and a needle selector 16 of which equivalents are disclosed in Japanese Examined Patent Application Publication No. 53(1978)43336 and Japanese Examined Patent Application Publication No. 55(1980)-8626.

According to the embodiment of the present invention, the needle selector 16 sets one of six needles 581, 582, 583, 584, 585, and 586 over the center hole 60. Therefore, an embroidering pattern can be stitched with a thread of the needle over the center hole 60.

An arm in FIG. 1 includes bobbin tables 55R and 55L, each of which respectively mounts thread bobbins thereon. According to the embodiment of the present invention, four thread bobbins can be always mounted around bobbin winders on each bobbin table 55R and 55L. Threads from the six thread bobbins among the eight thread bobbins are hooked to needles 581 through 586 through thread tensioners 61, holes in a thread guiding plate 62, and holes of take-up levers.

The embroidering machine EM is provided with a control device having a central processing unit (CPU, not shown) as a central role. When the embroidery data is transmitted to the control unit from the personal computer PC via an interface (not shown), a sewing pattern (an embroidering pattern) with plural colors can be stitched at a cloth (not shown) stretched over the embroidery frame 56.

A first memorizing unit in the personal computer PC is inputted with information for embroidering various types of patterns, i.e., embroidery data. Bach pattern is identified with a unique name (e.g. a file name). The information of the unique name for each pattern is configured with few control data and large stitch data. The control data includes data denoting a required thread color Ci and data denoting thread color selecting procedure. The stitch data is classified into two types; one is control data, and the other one is frame driving amount data The control data includes a thread change command data, an embroidering terminate command data, and so on. The frame driving amount data reads a required driving amount for driving the embroidery frame 56 from an embroidery frame position at a previous cycle. The embroidery frame position has been set to be a position over the center hole 60 at a starting time. The frame driving amount is defined with moving amounts of X-axis and Y-axis.

When the embroidering has been performed with no need of the thread change and with no need to finish the embroidering, the frame driving amount data is lined up in order by a single stitch. The thread change command data is inserted at a portion for changing the thread. The embroidering terminate command data is represented by an end of the stitch data. The embroidering performance can be finished at the end of the stitch data. The thread color decribed above is applied with an RGB (red-green-blue) code.

Further, the personal computer PC includes a second memorizing unit. Needle numbers N1 through N6 assigned for the six needles 581 through 586 and thread colors for the respective needles 581 through 586 are memorized in advance in the second memorizing unit in accordance with a formula [Nj, Cj](j=0=1, 2, 3, 4, 5, or 6) by use of a key board, a mouse, and other input devices.

Following procedures are taken in order to stitch a required pattern with various colors by the embroidering machine in response to operation of the embroidery system 10.

(1) A display (not shown) shows a colored image of the pattern with the required plural colors. The pattern in the display is illustrated in line drawing with colors corresponding to the thread colors.

(2) In order to alter the currently displayed color to a different color, a user can choose his favorite color among the colors in a color data table. The color data table is shown in the display when the user selects the line drawing. The predetermined thread color Ci in the control data is corrected in response to the newly selected color, and the needle number Ni is updated as well. When a thread with the newly selected color has not been supplied to any of the needles, a thread with a color that is most similar to the newly selected color can be selected.

(3) The embroidery data is transmitted to the CPU of the embroidering machine EM from the personal computer PC.

(4) The embroidering machine, which received the embroidery data, is driven and forms a pattern with plural colors specified by the embroidery data.

Figure 3:
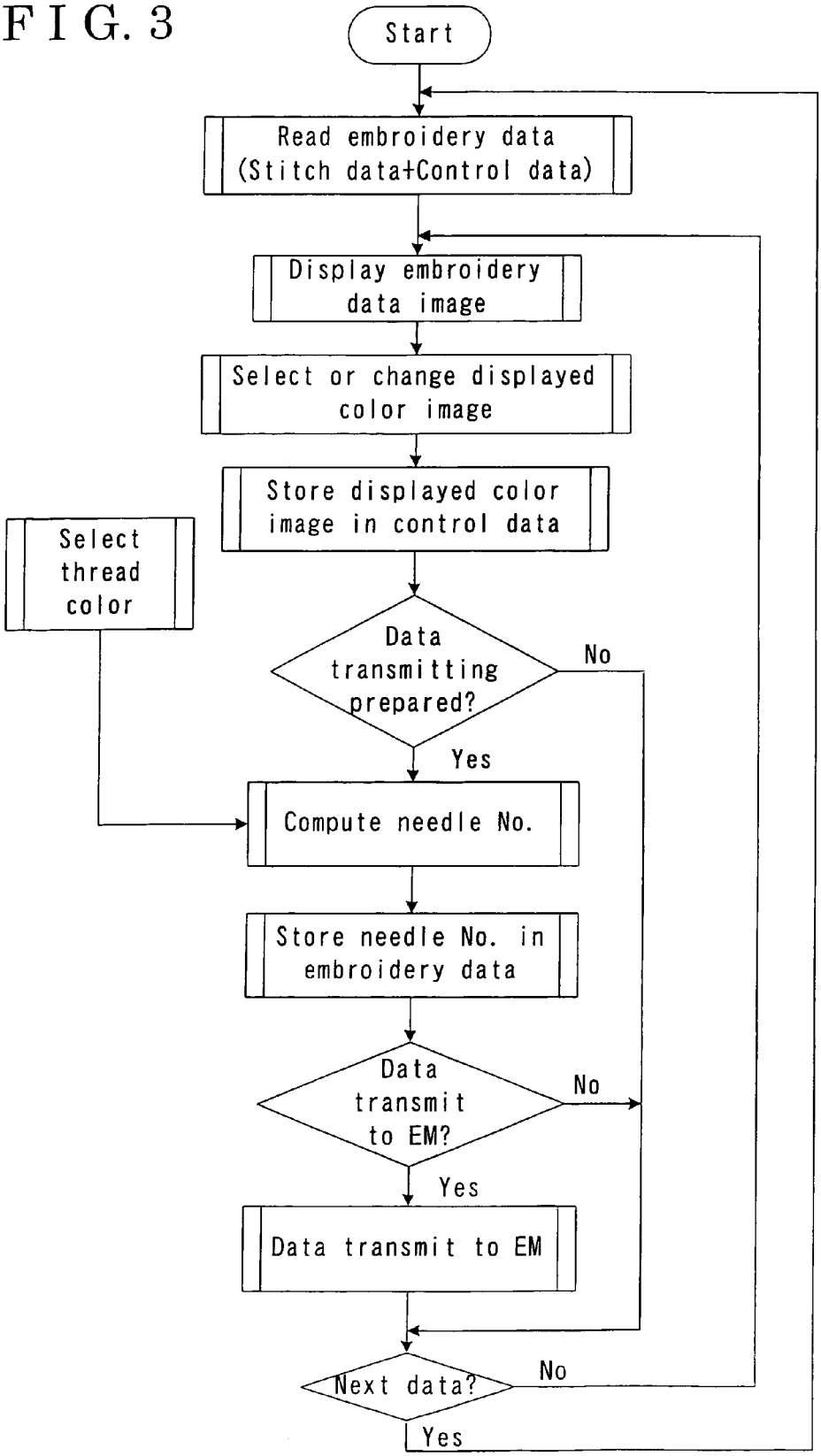
FIG. 3 is a flowchart for explaining an embroidering procedure according to the embodiment of the present invention

A flowchart illustrated in FIG. 3 explains the above-described procedure.

According to the embodiment of the present invention, the embroidering data is generated and memorized prior to being transmitted to the at least one embroidering machine EM. The embroidery data is corrected as required as the basis of needle numbers for the respective needles and the colors of the threads supplied to the respective needles. Therefore, an user does not necessarily have to change the currently mounted thread to a newly supplied thread even when the thread colors of the respective needles do not correspond to the color specified by the embroidery data. Especially in the embroidery system with plural embroidering machines EM, incredible efficiency can be achieved.

Further, according to the embodiment of the present invention, the needle numbers and the thread colors of the respective needles are controlled by the personal computer PC and separately from the embroidery data. Therefore, the embroidery data does not have to include the information on the needle numbers, thereby enabling to simplify a control program.

The principles, embodiments and modes of operation of the present invention have been described in the foregoing specification and drawings. However, the invention which is intended to be protected is not to be construed as limited to the particular embodiments disclosed. Further, the embodiments described herein are to be regarded as illustrative rather than restrictive. Plural objectives are achieved by the present invention, and yet there is usefulness in the present invention as far as one of the objectives are achieved. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An embroidering system comprising:

at least one embroidering machine having plural needles supplied with threads having different colors, the plural needles being identified respectively by plural needle numbers; and a control device for transmitting an embroidery data to the at least one embroidering machine so as to selectively drive the plural needles, the embroidery data generated and memorized in the control device prior to transmission thereof to the at least one embroidering machine, the embroidery data including the plural needle numbers and plural color codes for identifying a plurality of colors, each of the plural needle numbers being paired with a corresponding color code of the plural color codes, wherein, as required, the embroidery data is corrected such that when a first color code of the plural color codes is corrected to a specific color code, a needle number corresponding to the first color code is replaced by a needle number corresponding to the specific color code, and wherein one of the thread colors of the respective needles that is most similar to a color specified by the embroidery data is selected when the thread colors of the respective needles do not correspond to the color specified by the embroidery data upon correcting the embroidery data by the control device.

2. An embroidering system according to claim 1, wherein the control device is physically separated from the at least one embroidering machine.

3. The embroidery system according to claim 1, wherein a screen displays at least one correction to at least one of the plural color codes.

4. The embroidery system according to claim 3, wherein the screen is configured to enable a user to select a displayed thread color included in a pattern provided by the embroidery data to make the at least one correction.

5. An embroidering system comprising:

at least one embroidering machine having plural needles supplied with threads having different colors; and a control device for transmitting embroidery data to the at least one embroidering machine so as to selectively drive the plural needles, the embroidery data generated and memorized in the control device prior to being transmitted to the at least one embroidering machine, wherein the embroidery data is corrected as required, and wherein one of the thread colors of the respective needles, that is most similar to a color specified by the embroidery data is selected when the thread colors of the respective needles do not correspond to the color specified by the embroidery data upon correcting the embroidery data by the control device.

6. An embroidering system according to claim 5, wherein the control device is physically separated from the at least one embroidering machine.

7. An embroidering system, comprising:

at least one embroidering machine having a plurality of needles having at least two colors of thread; and a controller configured to transmit embroidery data to the at least one embroidering machine, wherein the embroidery data includes information related to selecting an alternative color when at least one of the at least two colors does not match a requirement of the embroidery data.

8. The embroidering system according to claim 7, wherein the controller selects the alternative color to be a color closest to the requirement.

9. The embroidering system according to claim 8, wherein the controller corrects at least one needle number for at least one needle of the plurality of needles based on the alternative color.

10. The embroidering system according to claim 7, wherein the controller corrects at least one needle number for at least one needle of the plurality of needles based on the alternative color.

11. The embroidering system according to claim 7, wherein the controller is configured to be separate from the at least one embroidering machine.

* * * * *